US005366304A

United States Patent [19]

Sheehan et al.

[11] Patent Number: 5,366,304

[45] Date of Patent: Nov. 22, 1994

[54] PRINTING RIBBON CASSETTE AND METHOD OF ASSEMBLY THEREOF

[75] Inventors: Bernard P. Sheehan, Cincinnati; James M. Seybold, Centerville, both of Ohio

[73] Assignee: NCR Corporation, Dayton, Ohio

[21] Appl. No.: 55,180

[22] Filed: Apr. 28, 1993

[51] Int. Cl.[5] ..... B41J 33/32

[52] U.S. Cl. ..... 400/248; 400/208

[58] Field of Search ..... 400/194, 196, 196.1, 400/208, 247, 248, 248.1

[56] References Cited

U.S. PATENT DOCUMENTS

| | | | |
|---|---|---|---|
| 4,856,923 | 8/1989 | Smith | 400/247 |
| 5,181,789 | 1/1993 | Blair | 400/247 |

FOREIGN PATENT DOCUMENTS

| | | | |
|---|---|---|---|
| 0158963 | 10/1985 | European Pat. Off. | 400/248 |
| 0015583 | 1/1991 | Japan | 400/248 |

*Primary Examiner*—Ren Yan

*Attorney, Agent, or Firm*—Craig E. Miller

[57] ABSTRACT

A continuous or endless loop printing ribbon cassette generally including a printing ribbon cassette body, a printing ribbon cassette nose clip member, and a continuous or endless loop inked printing ribbon. The printing ribbon cassette body includes a continuous or endless loop inked printing ribbon storage area, an outlet port, and an inlet port. The printing ribbon cassette nose clip member is positioned between the outlet port and the inlet port and locates continuous or endless loop inked printing ribbon in proper orientation relative to the interface between the print head and the printing medium. A nose clip modification insert is provided which, when assembled to the printing ribbon cassette nose clip member, closes a preexisting opening in the printing ribbon cassette nose clip member and extends an outer surface of the printing ribbon cassette nose clip member an additional distance sufficient to protect or prevent continuous or endless loop inked printing ribbon from being wrinkled or caught between the printing medium and the print head upon insertion of the printing medium into the printing equipment. In addition, a modified spring tensioner provides increased tension on continuous or endless loop inked printing ribbon prior to its exit from the outlet port. Furthermore, the printing ribbon cassette base and the printing ribbon cassette cover are rigidly connected to prevent the escape of continuous or endless loop inked printing ribbon from the printing ribbon cassette due to separation of the printing ribbon cassette base from the print ribbon cassette cover.

7 Claims, 5 Drawing Sheets

PRINTING RIBBON CASSETTE AND METHOD OF ASSEMBLY THEREOF

BACKGROUND AND SUMMARY OF THE INVENTION

The present invention relates generally to new and novel improvements in printing ribbon cassettes and methods for assembly thereof. More particularly, the present invention relates to modifications for and methods of incorporating such modifications into printing ribbon cassette kits to fabricate printing ribbon cassettes having enhanced performance characteristics when used in conjunction with associated printing equipment.

One widely used cost effective method of printing printed images on printing media, such as paper, is impact printing. In impact printing, printed images are formed on the printing medium from the impact of a print head or print element against an inked printing ribbon, which in turn transfers the printed images onto the printing medium. In typical applications, the print head is selectively energized and moves laterally a predetermined distance towards the printing medium into contact with the inked printing ribbon. This forces preselected areas of the inked printing ribbon against the printing medium and backing platen. Some of the ink present in the inked printing ribbon is then transferred to the printing medium at the preselected areas of contact between the print head and the printing medium. The print head is then deenergized and moves laterally away from contact with the printing medium, resulting in a printed image which remains on the printing medium having a configuration corresponding to the preselected areas of contact between the print head, the inked printing ribbon, and the printing medium.

Two types of print heads are commonly used in conjunction with impact printing. A first type of print head contains an entire printed image in a single print element, as in the case of conventional typewriters. A second type of print head consists of a matrix of print wires which are selectively energized to form a variety of printed images on the printing medium, as in the case of so called "dot matrix" printers. This second type of print head consisting of a matrix of print wires generally results in a more compact configuration and is widely used as a cost effective method of printing printed images onto printing media.

Two types of inked printing ribbons are commonly used in conjunction with impact printing equipment. One type of inked printing ribbon has two discrete ends and the inked printing ribbon travels from a supply spool, across an interface between the print head and the printing medium, and then to a take-up spool. Once the length of such an inked printing ribbon has traveled across the interface between the print head and the printing medium and is wound on the take-up spool, it is generally necessary to insert a replacement filled supply spool and a replacement empty take-up spool. While it is sometimes possible to interchange the empty supply spool and the filled take-up spool and continue with the printing operation; doing so still requires an interruption of the printing operation and the operator must take time to change and rethread the inked printing ribbon. Also, some printers automatically switch the direction of travel of the inked printing ribbon when an end of the inked printing ribbon is reached. However, providing such a printing ribbon travel switching mechanism generally complicates the design of such printers, and adds to the cost and complexity of these types of printers.

Another commonly used inked printing ribbon is a continuous or endless loop inked printing ribbon which continues to pass across the interface between the print head and the printing medium until the ink supply in the inked printing ribbon is exhausted, or until the accumulation of wear and tear on the inked printing ribbon from the impact of the print elements damages the ink retaining substrate. Such continuous or endless loop inked printing ribbons are preferred in many applications because the darkness of the printed images being formed can be monitored by the operator and replacement of the inked printing ribbon can generally be performed at a time convenient to the operator.

To simplify the installation and removal of continuous or endless loop inked printing ribbons in printing equipment, continuous or endless loop inked printing ribbons are often enclosed in printing ribbon cassettes. Such printing ribbon cassettes commonly include a ribbon storage area, a printing ribbon drive mechanism which is generally driven by the printing equipment, an outlet pore, and an inlet port. A portion of the continuous or endless inked printing ribbon extends between the outlet port and the inlet port and passes through the interface between the print head and the printing medium. Continuous or endless loop printing ribbon cassettes can generally be quickly and easily inserted into the printing equipment and can also be quickly and easily removed and replaced when the quality of the printed images deteriorates to an undesirable level.

One piece of printing equipment currently being marketed is the IBM 4683 Model 3 printer manufactured by International Business Machines Corporation (IBM), located in Armonk, N.Y. Lexmark International, Inc. of Greenwich, Conn. markets a IBM 4683 printing ribbon cassette for use with this machine. This printing ribbon cassette is compatible with the IBM 4683 Model 3 printer, but is relatively expensive to purchase.

Turbon International (Turbon) of Wuppertal, West Germany markets a printing ribbon cassette kit, designated as IL 411.00, which, when assembled with a continuous or endless loop of inked printing ribbon, is compatible with the IBM 4683 Model 3 printer. Printing ribbon cassettes assembled utilizing the Turbon IL 411.00 printing ribbon cassette kit are desirable to customers since they can be generally purchased for much less than the Lexmark 4683 printing ribbon cassette being marketed by Lexmark.

However, printing ribbon cassettes assembled utilizing the Turbon IL 411.00 printing ribbon cassette kits have been found to result in an undesirable rate of performance failures when used in conjunction with IBM 4683 Model 3 printers. Such failures include the continuous or endless loop inked printing ribbon becoming wrapped around the drive gear mechanism, the continuous or endless loop inked printing ribbon coming out of the printing ribbon cassette nose clip member which positions the inked printing ribbon in the interface between the print head and the printing medium, and the continuous or endless loop inked printing ribbon coming out of the printing ribbon cassette altogether due to separation between the printing ribbon cassette base and the printing ribbon cassette cover. Such performance failures have resulted in the printing equipment experiencing an undesirable amount of down time, the scrapping of printing media due to defective or missing printed images, the scrapping of the defective printing ribbon cassettes, and possible damage to the printing equipment.

According, an object of the present invention is the provision of a modified continuous or endless loop printing ribbon cassette compatible with IBM 4683 Model 3 printers fabricated from a Turbon IL 411.00 printing ribbon cassette kit which provides enhanced performance characteristics when used in conjunction with IBM 4683 Model 3 printers and similar printing equipment.

Another object of the present invention is to provide a nose clip insert which can be utilized in conjunction with a Turbon IL 411.00 printing ribbon cassette kit to fabricate a continuous or endless loop printing ribbon cassette which is compatible with IBM 4683 Model 3 printers and which provides enhanced performance characteristics when used in conjunction with IBM 4683 Model 3 printers and similar printing equipment.

A further object of the present invention is the provision of a method of assembling a modified continuous or endless printing ribbon cassette using a Turbon IL 411.00 printing ribbon cassette kit to fabricate a continuous or endless loop printing ribbon cassette which is compatible with IBM 4683 Model 3 printers and which provides enhanced performance characteristics when used in conjunction with IBM 4683 Model 3 printers and similar printing equipment.

These and other objects of the present invention are attained by the provision of a continuous or endless loop printing ribbon cassette having a printing ribbon cassette body, a printing ribbon cassette nose clip member, and a continuous or endless loop inked printing ribbon. The printing ribbon cassette body includes a continuous or endless loop inked printing ribbon storage area, an outlet port, and an inlet port. The printing ribbon cassette nose clip member is positioned between the outlet port and the inlet port and locates the continuous or endless loop inked printing ribbon in proper orientation relative to the interface between the print head and the printing medium. A nose clip modification insert is provided which, when assembled to the printing ribbon cassette nose clip member, closes a preexisting opening in the printing ribbon cassette nose clip member and extends an outer surface of the printing ribbon cassette nose clip member an additional distance sufficient to protect or prevent the continuous or endless loop inked printing ribbon from being wrinkled or caught between the printing medium and the print head upon insertion of the printing medium into the printing equipment. In addition, a modified spring tensioner provides increased tension on the continuous or endless loop inked printing ribbon prior to its exit from the outlet port. Furthermore, the printing ribbon cassette base and the printing ribbon cassette cover are rigidly connected in the vicinity of the drive gear mechanism to prevent the escape of the continuous or endless loop inked printing ribbon from the printing ribbon cassette due to separation of the printing ribbon cassette base from the print ribbon cassette cover.

Other objects, advantages and novel features of the present invention will become apparent in the following detailed description of the invention when considered in conjunction with the accompanying drawings.

DETAILED DESCRIPTION OF THE DRAWINGS

Figure 1:
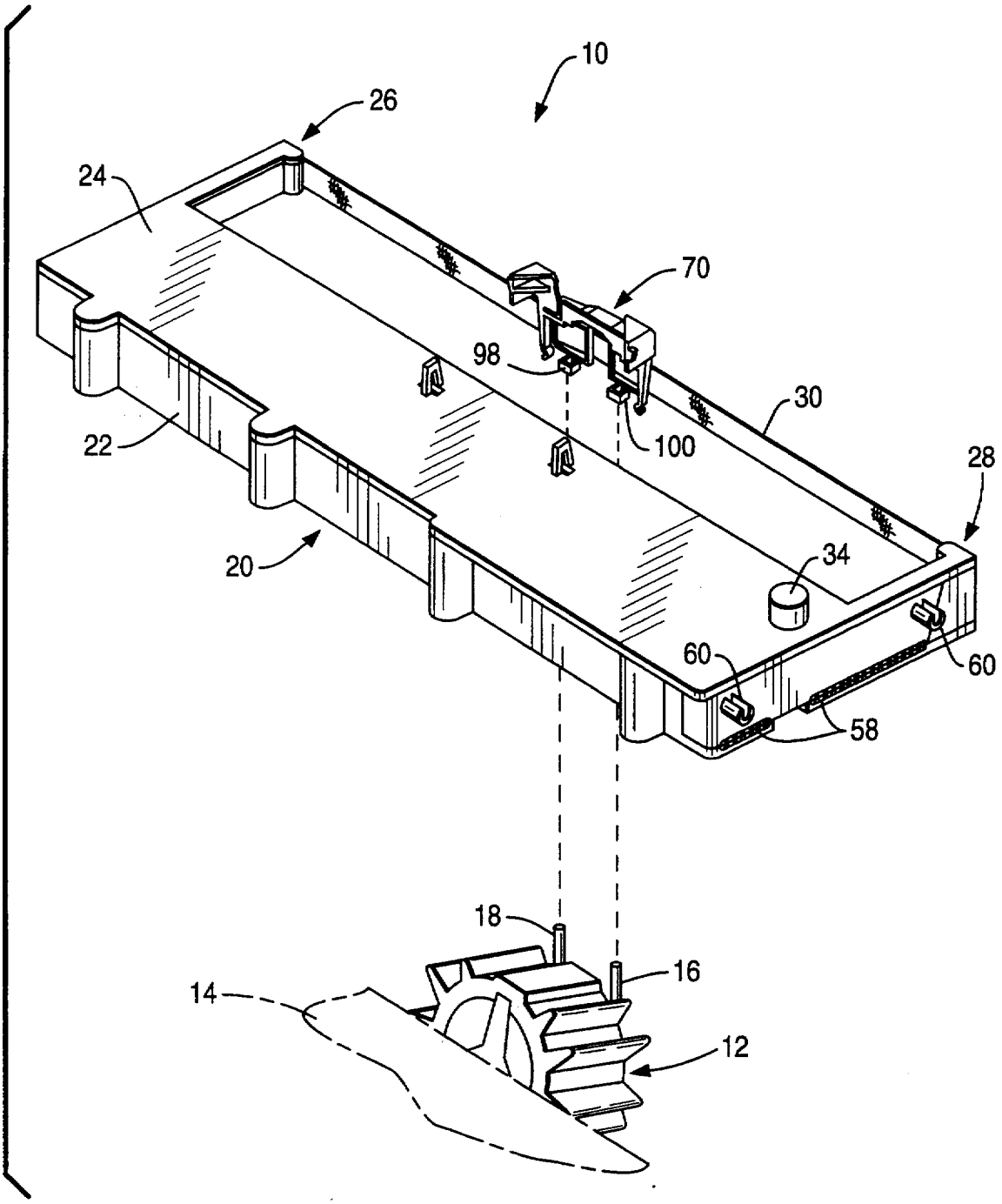
FIG. 1, which represents a preferred embodiment of a modified printing ribbon cassette in accordance with the present invention, shows an exploded perspective view of the printing ribbon cassette body, printing ribbon cassette nose clip member, a portion of the continuous or endless loop inked printing ribbon, and a print head, with the remainder of the printing equipment being represented by dashed lines.

Referring now to the drawings, in which like-referenced characters indicate corresponding elements throughout the several views, attention is first drawn to FIG. 1 which illustrates a preferred embodiment of the continuous or endless loop printing ribbon cassette, generally identified by reference numeral 10, in accordance with the present invention. Continuous or endless loop printing ribbon cassette 10 generally includes printing ribbon cassette body 20, continuous or endless loop inked printing ribbon 30, and printing ribbon cassette nose clip member 70. Continuous or endless printing ribbon cassette 10 is mounted on printing equipment 14 by aligning projections 60 extending from printing ribbon cassette body 20 with receiving slots (not shown) on printing equipment 14. Also, as seen in this figure, printing ribbon cassette nose clip member 70 is mounted on print head assembly 12 of the printing equipment (represented by dashed lines as reference numeral 14) by inserting two projections 16 and 18 upwardly extending from print head assembly 12 through apertures 98 and 100 and corresponding aligned apertures 104 and 106 in printing ribbon cassette nose clip member 70.

Figure 2:
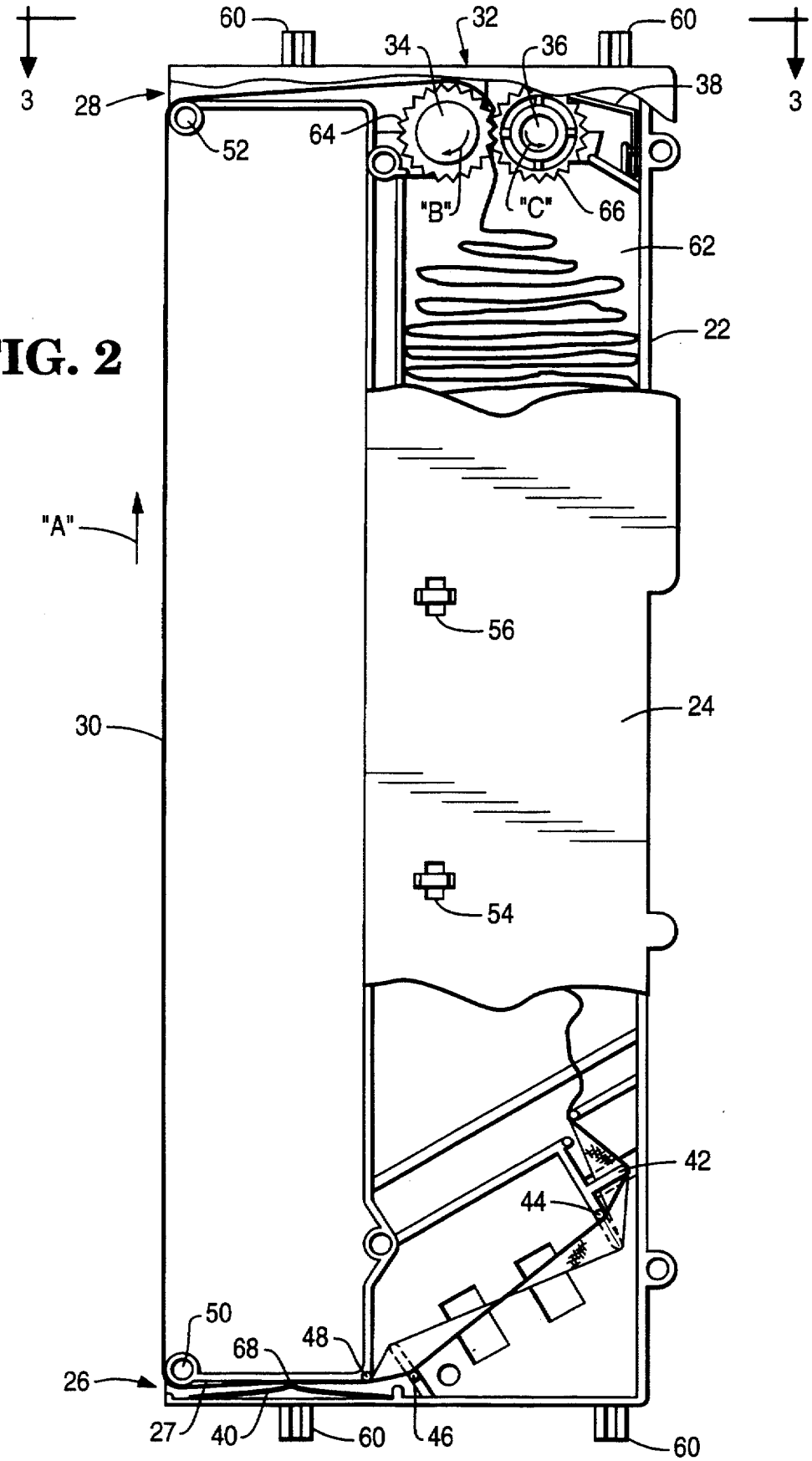
FIG. 2 is a top view of the printing ribbon cassette body shown in FIG. 1 with portions of the printing ribbon cassette cover member broken away for the purpose of illustration.

Referring now to FIG. 2, printing ribbon cassette body 20 consists generally of printing ribbon cassette base member 22 and printing ribbon cassette cover member 24. Continuous or endless loop inked printing ribbon 30 moves in the direction indicated by Arrow "A" and extends from outlet port 26 over cylindrical portion 50 through printing ribbon cassette nose clip member 70 (see FIG. 1) into inlet port 28 over corresponding cylindrical portion 52. From inlet port 28, continuous or endless loop inked printing ribbon 30 is pulled through drive gear assembly 32 into continuous or endless loop printing ribbon storage area 62 where continuous or endless loop inked printing ribbon 30 is stored or "stuffed" in a random orientation. From continuous or endless loop printing ribbon storage area 62, continuous or endless loop inked printing ribbon 30 is guided by projection 42, projection 44, projection 46, and guide post 48 to outlet port 26.

Drive gear assembly 32 consists of drive gear 34, a bottom portion (shown schematically in FIG. 3 as reference numeral 35) of which is driven by a drive member on printing equipment (represented by dashed lines in FIG. 1 as reference numeral 14). Drive gear 34 includes a plurality of outwardly extending teeth 64 which correspond to and engage with a plurality of outwardly extending teeth 66 on idler gear 36. Drive gear 34 and idler gear 36 each have a total of 24 outwardly extending teeth 64 and 66, respectively, which are approximately equidistantly spaced around the perimeter of drive gear 34 and idler gear 36. Continuous or endless loop inked printing ribbon 30 passes between drive gear 34 and idler gear 36 and is pulled into continuous or endless loop printing ribbon storage area 62 by the clockwise rotation of drive gear 34 (shown as Arrow "B" in FIG. 2), the resulting counterclockwise rotation of idler gear 36 (shown as Arrow "C" in FIG. 2), and the intermeshing of outwardly extending teeth 64 and 66 on drive gear 34 and idler gear 36, respectively.

Rotation inhibiting spring member 38 permits idler gear 36 to be rotated in the counterclockwise direction indicated by Arrow "C" in FIG. 2, but precludes rotation of idler gear 36 in the clockwise direction by entering into the space between adjacent outwardly extending teeth 66 on idler gear 36. However, because of the relatively course nature of outwardly extending teeth 64, i.e., adjacent teeth are spaced approximately 15 degrees apart around the perimeter of idler gear 36, idler gear 36 can "slip" or rotate counterclockwise up to approximately 15 degrees before rotation inhibiting spring member 38 moves over the peak of the next tooth and into the space between adjacent outwardly extending teeth 36. This degree of "slippage" or rotation in the clockwise direction can cause a loss of tension in continuous or endless loop inked printing ribbon 30 between outlet port 26 and inlet port 28.

Figure 8:
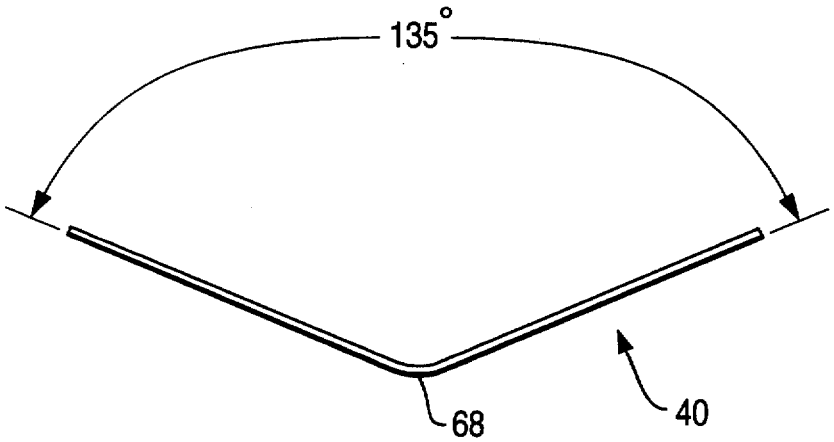
FIG. 8 is a top view of a modified spring tensioner as shown assembled in the printing ribbon cassette body in FIG. 2.
Figure 9:
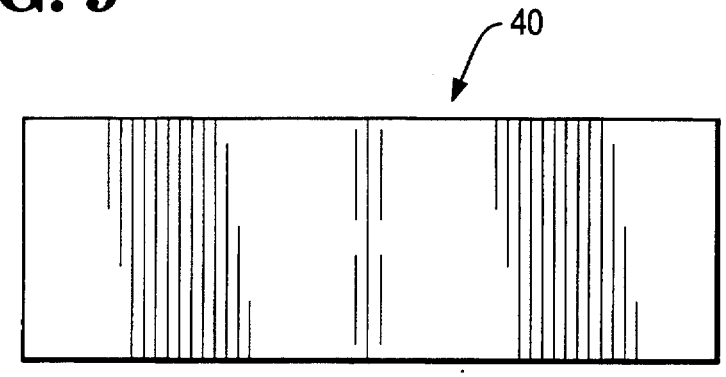
FIG. 9 is a side view of the modified spring tensioner as shown assembled in the printing ribbon cassette body in FIG. 2.

To compensate for this loss of tension in continuous or endless loop inked printing ribbon 30, tensioning spring member 40 is positioned in outlet port 26 as shown in FIG. 2. Tensioning spring member 40 contacts continuous or endless loop inked printing ribbon 30 along line 68 to retain or hold continuous or endless loop inked printing ribbon 30 between tensioning spring member 40 and interior wall 27 of outlet port 26. As seen in FIGS. 8 and 9, tensioning spring member 40 is preferably fabricated from 0.004 to 0.0045 inch thick 301 stainless steel and has an overall flat length of approximately 1,406 inches and a height of approximately 0.469 inches. Although tensioning spring member 40 provided with Turbon IL 411.00 printing ribbon cassette kit is formed to an angle of approximately 150 degrees, applicants have found that forming tensioning spring member 40 to a free angle of approximately 135 degrees as shown in FIG. 8 results in increased tension on continuous or endless loop inked printing ribbon 30. The free angle of approximately 135 degrees is created by using a fixture to form tensioning spring member 40 to an angle of less than 135 degrees, and allowing the material to spring back to the desired angle of approximately 135 degrees.

Figure 3:
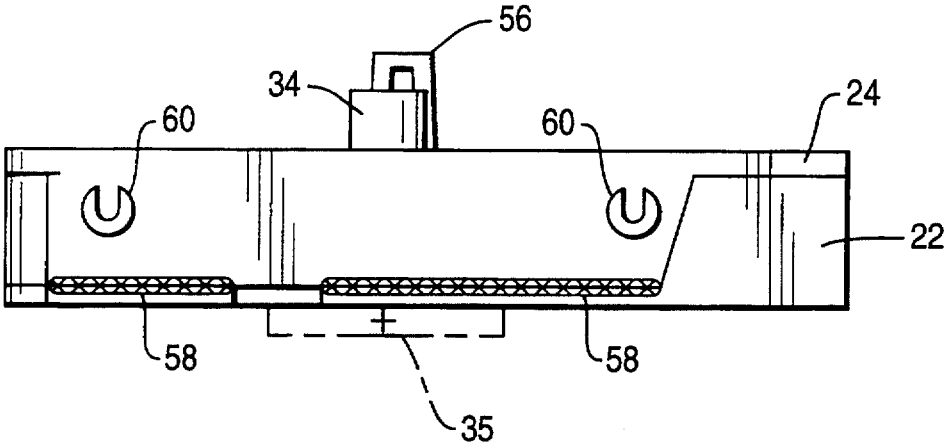
FIG. 3 is a side view of the printing ribbon cassette body shown in FIG. 1 taken across lines 3—3 in FIG. 2.

Referring to FIGS. 1 and 3, printing ribbon cassette base member 22 is preferably rigidly connected to printing ribbon cassette cover member 24 in the vicinity of drive gear mechanism 32 as identified by reference numeral 58 to prevent the escape of continuous or endless loop inked printed ribbon 30 through a gap caused by the separation of printing ribbon cassette base member 22 and printing ribbon cassette cover member 24. Rigid connection 58 could be accomplished by several methods, including fusion bonding, ultrasonic welding, or the use of threaded fasteners. While it is recognized that rigid connection 58 could extend around the entire perimeter of printing ribbon cassette base member 22 and printing ribbon cassette cover member 24, applicants have found that a rigid connection along the wall adjacent drive gear mechanism 32 will adequately serve the intended purpose.

Figure 4:
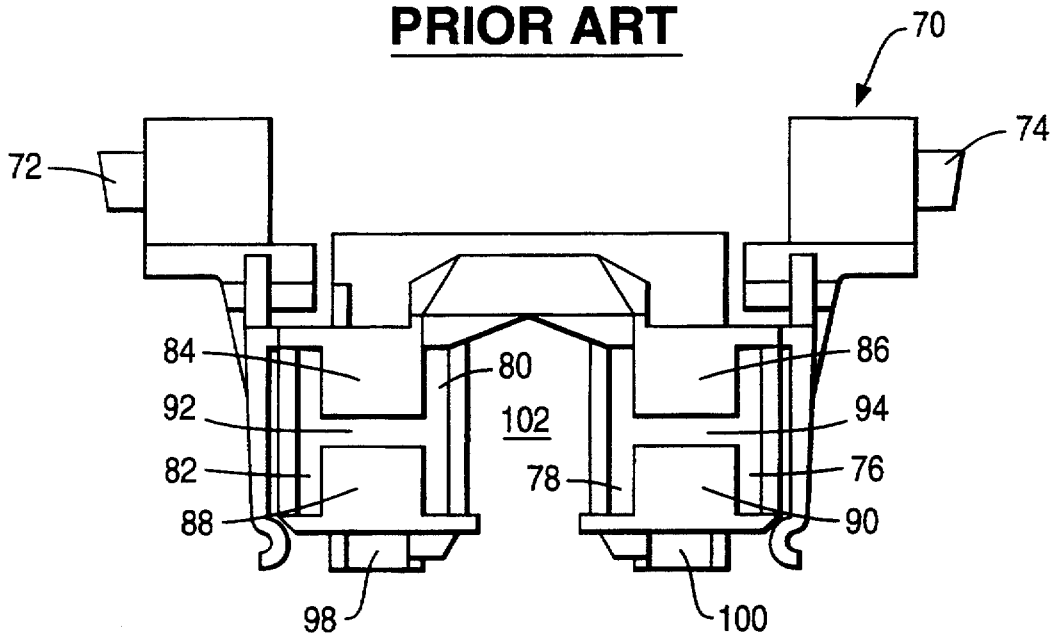
FIG. 4 PRIOR ART
FIG. 4 is a front view of the printing ribbon cassette nose clip member shown in FIG. 1.
Figure 5:
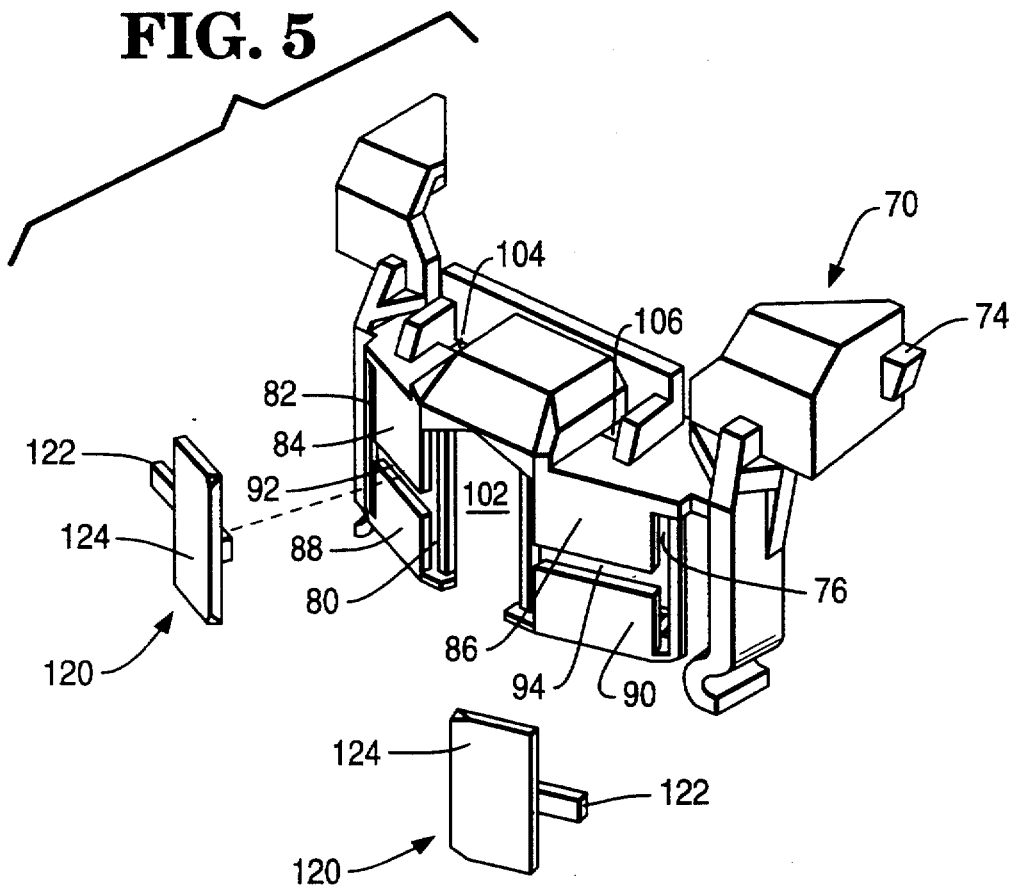
FIG. 5 is an exploded perspective view of the printing ribbon cassette nose clip member shown in FIG. 1, and two nose clip modification inserts.

Referring now to FIGS. 4 and 5, printing ribbon cassette nose clip member 70 is shown. Printing ribbon cassette nose clip member as provided in Turbon IL 411.00 is identified as reference numeral 70 in FIGS. 4 and 5. Printing ribbon cassette nose clip member 70 includes outwardly extending ear tabs 72 and 74 which engage with upwardly extending apertures 54 and 56 in printing ribbon cassette cover member 24 to secure printing ribbon cassette nose clip member 70 to printing ribbon cassette cover member 24 during transportation or when modified printing ribbon cassette 10 is not being used. Printing ribbon cassette nose clip member 70 is preferably fabricated from a relatively flexible polymeric material which provides sufficient flexibility and memory to allow outwardly extending ear tabs 72 and 74 to be squeezed inwardly and placed between upwardly extending apertures 54 and 56. When released, outwardly extending ear tabs 72 and 74 move outwardly and are retained in upwardly expending apertures 54 and 56.

In operation, continuous or endless loop inked printing ribbon 30 is positioned to pass inwardly through slot 76, behind downwardly extending tab 86 and upwardly extending tab 90, and outwardly through slot 78. Similarly, on the other side of printing ribbon cassette nose clip member 70, continuous or endless loop inked printing ribbon 30 is positioned to pass inwardly through slot 80, behind downwardly extending tab 84 and upwardly extending nab 88, and outwardly through slot 82. Thus, continuous or endless loop inked printing ribbon 30 is held in position relative to print head 12 across opening 102 between slot 78 and 80.

To simplify the threading of continuous or endless loop inked printing ribbon 30 behind downwardly extending tab 84 and upwardly extending tab 88, opening 92 is provided in printing ribbon cassette nose clip member 70 provided with the Turbon 411.00 printing ribbon cassette kit. Similarly, opening 94 is provided between downwardly extending tab 86 and upwardly extending tab 90. Openings 92 and 94 between downwardly extending tabs 84 and 86 and upwardly extending tabs 88 and 90 are present to simplify the threading of continuous or endless loop inked printing ribbon 30 by allowing a longitudinal edge of continuous or endless inked printing ribbon 30 to be inserted through openings 92 and 94 in position behind downwardly extending tabs 84 and 86 and upwardly extending tabs 88 and 90. However, applicants have found that the presence of openings 92 and 94 also permits continuous or endless loop inked printing ribbon 30 to escape from behind downwardly extending tabs 84 and 86 and upwardly extending tabs 88 and 90 during installation of printing ribbon cassette onto the printing equipment or during operation of the printing equipment. The escape of continuous or endless loop inked printing ribbon 30 through openings 92 and 94 has been found to be particularly prevalent when print head 12 contacts continuous or endless loop inked printing ribbon 30 during installation of the printing ribbon cassette onto the printing equipment, or from loss of tension in continuous or endless loop inked printing ribbon 30 between outlet port 26 and inlet port 28. Furthermore, applicants have found that in the printing ribbon cassette nose clip 70 provided with the Turbon IL 411.00 printing ribbon cassette kit, print head 12 can extend a distance beyond the outer surfaces of downwardly extending tabs 84 and 86 and upwardly extending tabs 88 and 90, thus forcing continuous or endless loop printing ribbon to be in the path of the printing medium during insertion into and removal of the printing medium from the printing equipment. In summary, because of the above deficiencies, applicants have experienced an unacceptably high rate of printing ribbon cassette operational failures from use of printing ribbon cassettes fabricated from Turbon 411.00 printing ribbon cassette kits.

Figure 6:
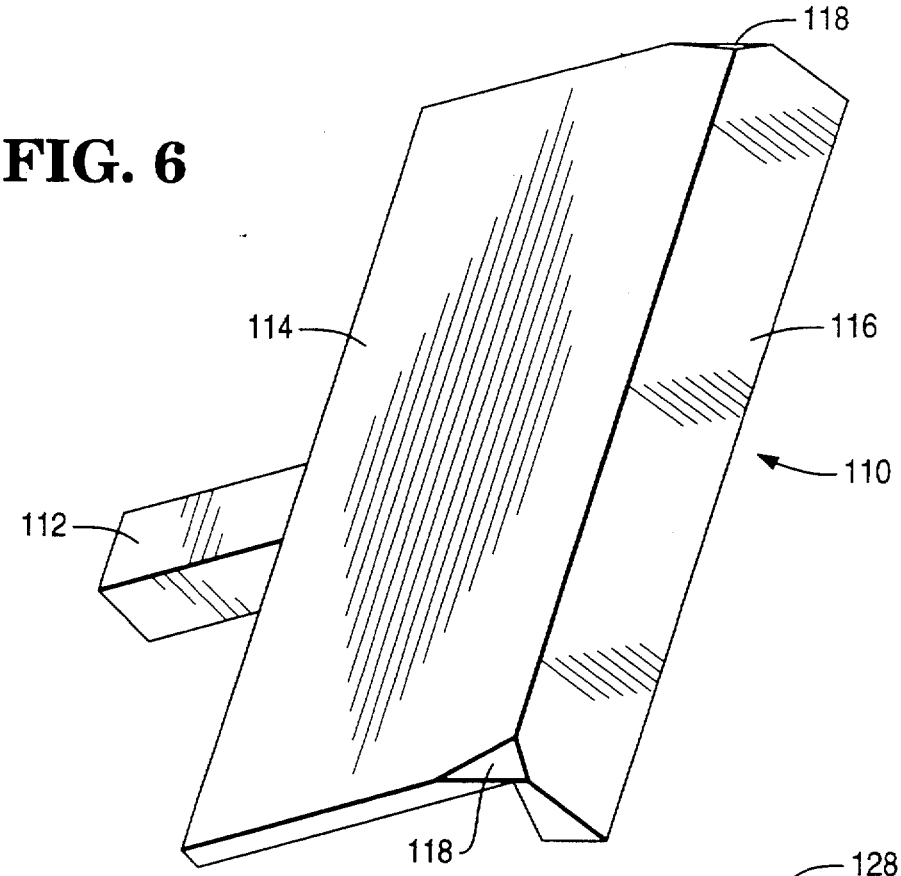
FIG. 6 is a perspective view of a first embodiment of a nose clip modification insert for use in conjunction with the printing ribbon cassette nose clip member.
Figure 7:
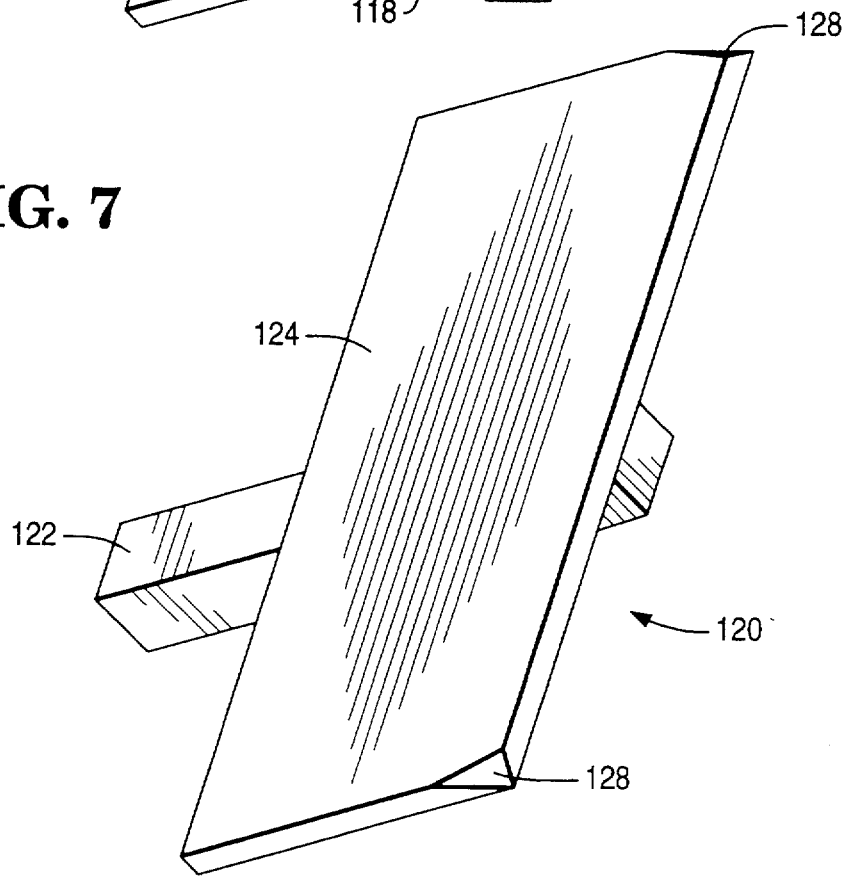
FIG. 7 is a perspective view of a second embodiment of a nose clip modification insert for use in conjunction with the printing ribbon cassette nose clip member.

To overcome the deficiencies described above, applicants have developed a nose clip modification insert, a first embodiment of which is shown in FIG. 6, generally identified by reference numeral 110, and a second embodiment of which is shown in FIG. 7, generally identified by reference numeral 120. Turning first to FIG. 6, nose clip modification insert 110 includes horizontally extending portion 112 which runs the entire width of nose clip modification insert 110. Horizontally extending portion 112 is dimensioned to be received in openings 92 and 94 between downwardly extending tabs 84 and 86 and upwardly extending tabs 88 and 90, respectively, and is approximately the same length as openings 92 and 94. Nose clip modification insert 110 further includes planar portion 114 on top of horizontally extending portion 112. Planar portion 114 preferably extends a distance upwardly from horizontally extending portion 112 approximately equal to the height of downwardly extending tabs 84 and 86. Similarly, planar portion 114 preferably extends a distance downwardly from horizontally extending portion 112 approximately equal to the height of upwardly extending tabs 88 and 90. To conserve material, and to provide a more compact inserts planar member 114 preferably extends a distance of from approximately 50 percent to 67 percent of the length of horizontally extending portion 112. To assist in positioning nose clip modification insert 110 on the respective set of downwardly extending tabs 84 or 86 and upwardly extending tabs 88 and 90, downwardly extending portion 116, located along the edge of planar portion 114 adjacent the end of horizontally extending portion 112, is provided. The transition between planar portion 114 and downwardly extending portion 116 includes corner breaks 118 at the top and bottom to provide a smooth transition for the insertion of the printing medium past this surface.

Referring now to FIG. 7, a second embodiment of nose clip modification insert 120 is shown. Nose clip modification insert 120 is similar in configuration to nose clip modification insert 110, except downwardly extending portion 116 is not present. Thus, clip modification insert 120 includes horizontally extending portion 122 similar to horizontally extending portion 112 and planar portion 124 similar to planar portion 114. The top and bottom of planar portion 124 distal from the exposed horizontally extending portion 122 includes corner breaks 128 to provide a smooth transition for the insertion of the printing medium past this surface. Nose clip modification insert 120 is generally easier to fabricate than nose clip modification insert 110, and uses less material, but is somewhat more difficult to position during assembly.

To assemble nose clip modification inserts 110 or 120 on printing ribbon cassette nose clip member, a suitable adhesive is placed on the outer surfaces of downwardly extending tabs 84 or 86 and upwardly extending tabs 88 and 90. Horizontally extending portion 112 or 122 is then positioned in openings 92 or 94 between downwardly extending tabs 84 or 86 and upwardly extending tabs 88 or 90 with the portion of horizontally extending portion 112 or 122 distal to planar portion 114 or 124 positioned towards openings 76 or 82. Since both nose clip modification inserts 110 and 120 are symmetrical, they can be used interchangeably to cover either opening 92 between downwardly extending tab 84 and upwardly extending tab 88 or opening 94 between downwardly extending tab 86 and upwardly extending tab 90. Once horizontally extending portion 112 is positioned in opening 92 or 94, nose clip modification insert 110 is moved horizontally so downwardly extending portion 116 is positioned against the edge of openings 78 or 80. Nose clip modification insert 110 is held in this position until the adhesive on downwardly extending tabs 84 or 86 and upwardly extending tabs 88 or 90 sets sufficiently to hold nose clip modification insert 110 in this position. Since nose clip modification insert 120 does not have a stop, nose clip modification insert 120 is moved and visibly aligned as near as possible to the edge of openings 78 or 80 and held in this position until the adhesive on downwardly extending tabs 84 or 86 and upwardly extending tabs 88 or 90 sets sufficiently to hold nose clip modification insert 120 in this position.

As described above, modified printing ribbon cassette 10 fabricated from Turbon IL 411.00 printing ribbon cassette kit is compatible with IBM 4683 Model 3 printers and includes at least four features which enhance the performance characteristics when used with the IBM 4683 Model 3 printer or similar printers. First, openings 92 and 94 between downwardly extending tabs 84 and 86 and upwardly extending tabs 88 and 90 are blocked by nose clip modification insert 110 or 120 to preclude continuous or endless loop inked printing ribbon 30 from slipping out of printing ribbon cassette nose clip member 70 through openings 92 and 94. Second, the outer surface of downwardly extending tabs 84 and 86 and upwardly extending tabs 88 and 90 is effectively moved outwardly approximately 0.015 inches to adequately shield or provide clearance between print head 12 and continuous or endless loop inked printed ribbon 30 when the printing medium is inserted or removed from printing equipment 14. Third, modified tensioning spring member 40 increases the tension on continuous or endless loop inked printing ribbon 30 between outlet port 26 and inlet port 28. Fourth, printing ribbon cassette base member 22 and printing ribbon cassette cover member 24 are rigidly connected in the vicinity of drive gear mechanism 32 to prevent separation of printing ribbon cassette base member 22 and printing ribbon cassette cover member 24, and the escape of continuous or endless loop inked printing ribbon 30 therebetween.

Although the present invention has been described above in detail, the same is by way of illustration and example only and is not to be taken as a limitation on the present invention. For example, printing ribbon cassette base member 22 could be rigidly connected to printing ribbon cassette cover member 24 in the vicinity of drive gear mechanism 32 by a number of alternative methods, for example using ultrasonic welding, adhesive bonding, threaded fasteners, etc. Accordingly, the scope and content of the present invention are to be defined only by the terms of the appended claims.

What is claimed is:

1. A continuous or endless loop printing ribbon cassette for use with an impact printer having a print head, said continuous or endless loop printing ribbon cassette comprising:

a printing ribbon cassette body having an inlet port, an outlet port and a continuous or endless loop printing ribbon storage area therebetween;

a continuous or endless loop inked printing ribbon, a portion of which extends from said continuous or endless loop printing ribbon storage area, out of said continuous or endless loop printing ribbon cassette through said outlet port and back into said continuous or endless loop printing ribbon storage area through said inlet port;

a printing ribbon cassette nose clip member on said continuous or endless loop inked printing ribbon intermediate said outlet port and said inlet port, said printing ribbon cassette nose clip member including a first slot, a second slot, a third slot and a fourth slot for threading said continuous or endless loop inked printing ribbon therethrough;

said printing ribbon cassette nose clip member further including a first downwardly extending tab, a first upwardly extending tab and a first opening therebetween intermediate said first slot and said second slot, a second opening intermediate said second slot and said third slot for orienting said continuous or endless loop inked printing ribbon in relation to the print head and a second downwardly extending tab, a second upwardly extending tab and a third opening therebetween intermediate said third slot and said fourth slot;

said continuous or endless loop printing ribbon being threaded through said printing ribbon cassette nose clip by entering inwardly through said first slot to be positioned behind said first downwardly extending tab, said first upwardly extending tab and said first opening, exiting outwardly through said second slot and across said second opening, entering inwardly through said third slot to be positioned behind said second downwardly extending tab, said second upwardly extending tab and said third opening, and exiting outwardly through said fourth slot;

a first nose clip modification insert adhered to an outer surface of said first downwardly extending tab and to an outer surface of said first upwardly extending tab to cover said first opening and block the passage of said continuous or endless loop inked printing ribbon therethrough;

a second nose clip modification insert adhered to an outer surface of said second downwardly extending tab and to an outer surface of said second upwardly extending tab to cover said third opening and block the passage of said continuous or endless loop inked printing ribbon therethrough; and wherein said first nose clip modification insert includes a horizontally extending portion which enters into said first opening and said second nose clip modification insert includes a horizontally extending portion which enters into said third opening.

2. The continuous or endless loop printing ribbon cassette in accordance with claim 1, wherein said first nose clip modification insert and said second nose clip modification insert are fabricated from a polymeric material.

3. The continuous or endless loop printing ribbon cassette in accordance with claim 2, wherein said first nose clip modification insert and said second nose clip modification insert are separate and interchangeable.

4. A method of modifying a continuous or endless loop printing ribbon cassette for use with an impact printer having a print head, said continuous or endless loop printing ribbon cassette including a printing ribbon cassette having an inlet port, an outlet port and a continuous or endless loop printing ribbon storage area therebetween, a continuous or endless loop inked printing ribbon, a portion of which extends from said continuous or endless loop printing ribbon storage area, out of said continuous or endless loop printing ribbon cassette through said outlet port and back into said continuous or endless loop printing ribbon storage area through said inlet port, a printing ribbon cassette nose clip member on said continuous or endless loop inked printing ribbon intermediate said outlet port and said outlet port, said printing ribbon cassette nose clip member including a first slot, a second slot, a third slot and a fourth slot for threading said continuous or endless loop inked printing ribbon therethrough, said printing ribbon cassette nose clip member further including a first downwardly extending tab, a first upwardly extending tab and a first opening intermediate said first slot and said second slot, a second opening intermediate said second slot and said third slot for orienting said continuous or endless loop inked printing ribbon in relation to the print head and a second downwardly extending tab, a second upwardly extending tab and a third opening therebetween intermediate said third slot and said fourth slot, said continuous or endless loop printing ribbon being threaded through said printing ribbon cassette nose clip by entering inwardly through said first slot to be positioned behind said first downwardly extending tab, said first upwardly extending tab and said first opening, exiting outwardly through said second slot and across said second opening, entering inwardly through said third slot to be positioned behind said second downwardly extending tab, said second upwardly extending tab and said third opening, and exiting outwardly through said fourth slot, said method of modifying said continuous or endless loop printing ribbon cassette comprising the steps of:

providing a first nose clip modification insert having a horizontally extending portion thereon; inserting said horizontally extending portion of said first nose clip modification insert into said first opening between said first downwardly extending tab and said first upwardly extending tab in said printing ribbon cassette nose clip member;

adhering said first nose clip modification insert to an outer surface of said first downwardly extending tab and to an outer surface of said first upwardly extending tab to cover said first opening and block the passage of said continuous or endless loop inked printing ribbon therethrough;

providing a second nose clip modification insert having a horizontally extending portion thereon; inserting said horizontally extending portion of said second nose clip modification insert into said third opening between said second downwardly extending tab and said second upwardly extending tab in said printing ribbon cassette nose clip member; and adhering said second nose clip modification insert to an outer surface of said second downwardly extending tab and to an outer surface of said second upwardly extending tab to cover said third opening and block the passage of said continuous or endless loop inked printing ribbon therethrough.

5. A nose clip modification insert in combination with a continuous or endless loop printing ribbon cassette for use with an impact printing having a print head, said continuous or endless loop printing ribbon cassette having a printing ribbon cassette body having an inlet port, an outlet port and a continuous or endless loop printing ribbon storage area therebetween, a continuous or endless loop inked printing ribbon, a portion of which extends from said continuous or endless loop printing ribbon storage area, out of said continuous or endless loop printing ribbon cassette through said outlet port and back into said continuous or endless loop printing ribbon storage area through said inlet port, a printing ribbon cassette nose clip member on said continuous or endless loop inked printing ribbon intermediate said outlet port and said inlet port, said printing ribbon cassette nose clip member including a first slot, a second slot, a third slot and a fourth slot for threading said continuous or endless loop inked printing ribbon therethrough, said printing ribbon cassette nose clip member further including a first downwardly extending tab, a first upwardly extending tab and a first opening therebetween intermediate said first slot and said second slot, a second opening intermediate said second slot and said third slot for orienting said continuous or endless loop inked printing ribbon in relation to the print head and a second downwardly extending tab, a second upwardly extending tab and a third opening therebetween intermediate said third slot and said fourth slot, said continuous or endless loop printing ribbon being threaded through said printing ribbon cassette nose clip by entering inwardly through said first slot to be positioned behind said first downwardly extending tab, said first upwardly extending tab and said first opening, exiting outwardly through said second slot and across said second opening, entering inwardly through said third slot to be positioned behind said second downwardly extending tab, said second upwardly extending tab and said third opening, and exiting outwardly through said fourth slot, said nose clip modification insert comprising:

a horizontally extending portion for insertion into one of said first opening between said first downwardly extending tab and said first upwardly extending tab of said printing ribbon cassette nose clip member and said third opening between said second downwardly extending tab and said second upwardly extending tab of said printing ribbon cassette nose clip member; and a planar portion extending transversely from said horizontally extending portion for adhesion to one of an outer surface of said first upwardly extending tab and said second upwardly extending tab and to one of an outer surface of said first downwardly extending tab and said second downwardly extending tab.

6. The nose clip modification insert in accordance with claim 5, wherein said horizontally extending portion extends beyond one edge of said planar portion.

7. The nose clip modification insert in accordance with claim 6, wherein said nose clip modification insert is fabricated from a polymeric material.

* * * * *